US005135434A

United States Patent [19]

Mallon

[11] Patent Number: 5,135,434

[45] Date of Patent: Aug. 4, 1992

[54] INTEREST PAYING BANK

[75] Inventor: Andrew B. Mallon, New York, N.Y.

[73] Assignee: First National Piggy Bank, Ltd., New York, N.Y.

[21] Appl. No.: 610,156

[22] Filed: Nov. 7, 1990

[51] Int. Cl.[5] ..... G07F 9/00

[52] U.S. Cl. ..... 453/43; 446/9; 453/49; 194/334; 194/351

[58] Field of Search ..... 453/43, 44, 49; 221/264; 194/294, 298, 334, 351; D99/37, 40; 446/9, 12; 206/0.82, 0.83, 0.84

[56] References Cited

U.S. PATENT DOCUMENTS

| | | | |
|---|---|---|---|
| D. 303,035 | 8/1989 | O'Dunlaing | D99/40 |
| 591,110 | 10/1897 | Clarke | 194/298 |
| 1,010,993 | 12/1911 | White | 194/298 |
| 1,157,826 | 10/1915 | Walker et al. | 453/44 |
| 1,412,565 | 4/1922 | Millard | 194/294 |
| 1,441,324 | 1/1923 | Beaulieu | 194/298 |
| 1,594,847 | 8/1926 | Otto | 446/9 |
| 1,601,980 | 10/1926 | Potterf | 194/294 |
| 3,858,701 | 1/1975 | Bauer et al. | 194/339 |

FOREIGN PATENT DOCUMENTS

| | | | |
|---|---|---|---|
| 918720 | 10/1954 | Fed. Rep. of Germany | 446/9 |
| 613023 | 11/1960 | Italy | 453/44 |

*Primary Examiner*—Robert J. Spar
*Assistant Examiner*—William M. Hienz
*Attorney, Agent, or Firm*—Lieberman Rudolph & Nowak

[57] ABSTRACT

A bank having a coin slot and a repository for deposited coins is provided. The bank can detect coins deposited. A coin is returned upon deposit of a predetermined amount of money to return interest such as a nickel in interests for depositing twenty-five cents.

2 Claims, 6 Drawing Sheets

FIG. 5
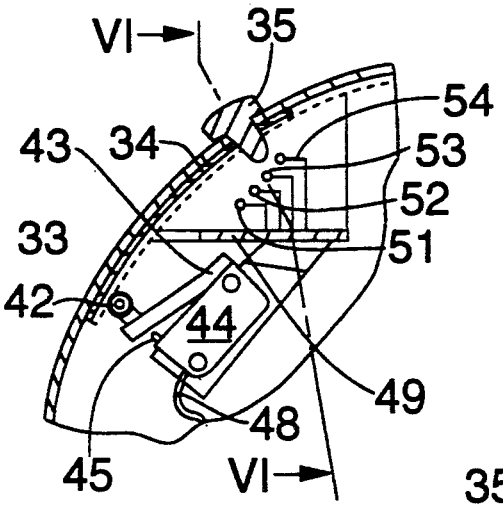
FIG. 7
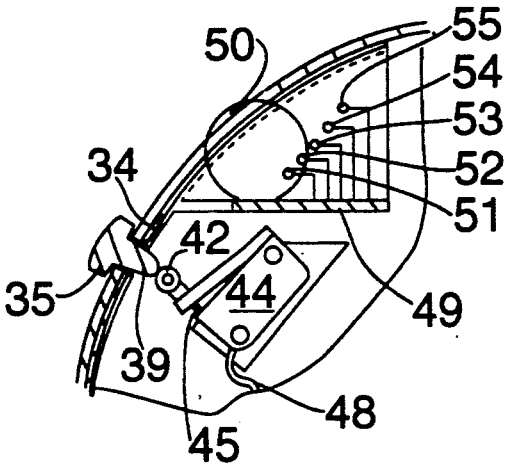
FIG. 6
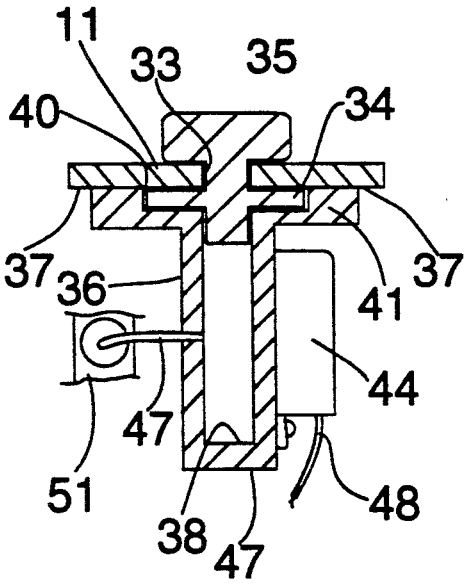
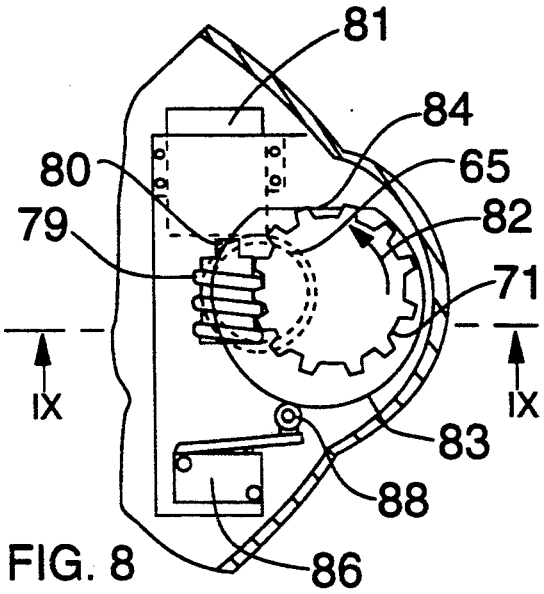
FIG. 8

INTEREST PAYING BANK

BACKGROUND OF THE INVENTION

1. Field of the Invention

The invention relates to toy banks; and, more particularly, to a bank adapted to return a predetermined amount of money as interest after coins have been deposited.

2. Description of the Prior Art

For many years there has been a need for impressing upon people the benefits of saving money. Currently, the United States has a savings rate lower than that of other industrialized countries. A toy bank that encourages children to save money while simultaneously teaching concepts of interest would help solve a problem of national importance.

Banks for saving coins are well known and have been around for many years. In U.S. Pat. No. 3,858,701, issued Jan. 7, 1975, to Bauer, et al., the patentees recognized the desirability of teaching children who use such tanks how to save money while realizing the possibility of receiving interest on the money deposited into the bank. Bauer, et al.'s bank releases a coin in response to each coin being deposited, but does not deliver the released coin to the child. Thus, Bauer, et al. do not teach one of the most important aspects of saving, i.e., the reward of actually receiving interest payments. Moreover, in the more advanced embodiments of the subject invention, an accumulation of coins adding up to a predetermined amount can result in interest being paid to the saver.

Thus, there is a need for a bank which accumulates the coins being deposited and returns to the saver a predetermined amount of interest based on the value of the deposited coins.

SUMMARY OF THE INVENTION

The subject invention provides a savings bank comprising a housing defining an interior space which is capable of containing a plurality of coins, the housing having an opening leading into the interior space. The subject invention includes coin detecting and signalling means connected to the housing and associated with the opening, the means being capable of detecting a coin of a given denomination that has been deposited into the opening and generating a signal; and coin storage and return means in the interior space of the housing connected to the detecting and signalling means, the storage and return means being capable of storing a plurality of coins of a predetermined denomination in the interior of the housing and returning one of the coins of predetermined denomination to the exterior of the housing upon receipt of a signal from the coin detecting and signaling means.

BRIEF DESCRIPTION OF THE DRAWING

FIG. 5 is a detailed sectional view of a portion of the bank of FIGS. 1 to 4;

FIG. 6 is a view taken along lines VI—VI of FIG. 5;

FIG. 7 is a view similar to FIG. 5 showing another position of the components thereof;

FIG. 8 is a detailed sectional view of another portion of the bank of FIGS. 1 to 4;

DETAILED DESCRIPTION OF THE INVENTION

The subject invention provides a savings bank having a housing adapted to contain a plurality of deposited coins therein. The housing has an opening leading to the interior. Coin detecting and signalling means are associated with the opening. These means detect the coins deposited into the opening and generate a signal which is transmitted to the coin storage and return means. Coin storage and return means are provided in the housing and are coupled to the detecting and signalling means. A plurality of coins of a predetermined denomination can be stored by the coin storage and return means in the interior of the housing. One of the coins of a predetermined denomination are returned to the exterior of the housing upon receiving a signal from the coin detecting and signalling means.

The following is a description of a preferred embodiment of the subject invention. This embodiment is illustrative and should not be viewed as limiting the claims or their equivalents. Upon reading the subject application obvious variations of this invention will become apparent. Such variations are to be considered within the scope and spirit of the subject invention.

Figure 1:
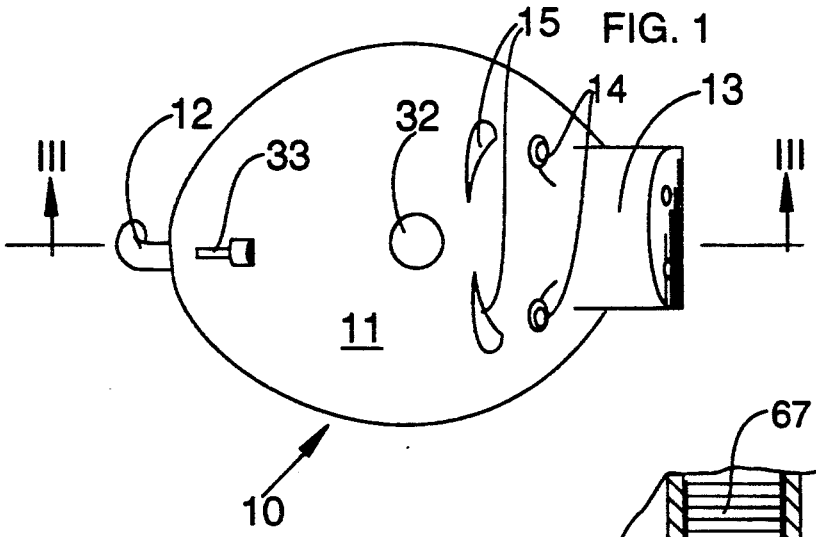
FIG. 1 is a top plan view of a bank in accordance with the teachings of the invention.
Figure 2:
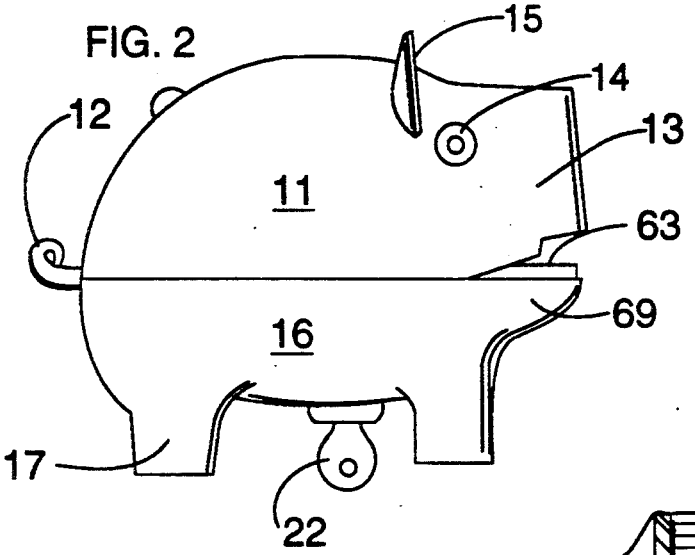
FIG. 2 is a vertical view of the bank of FIG. 1.
Figure 3:
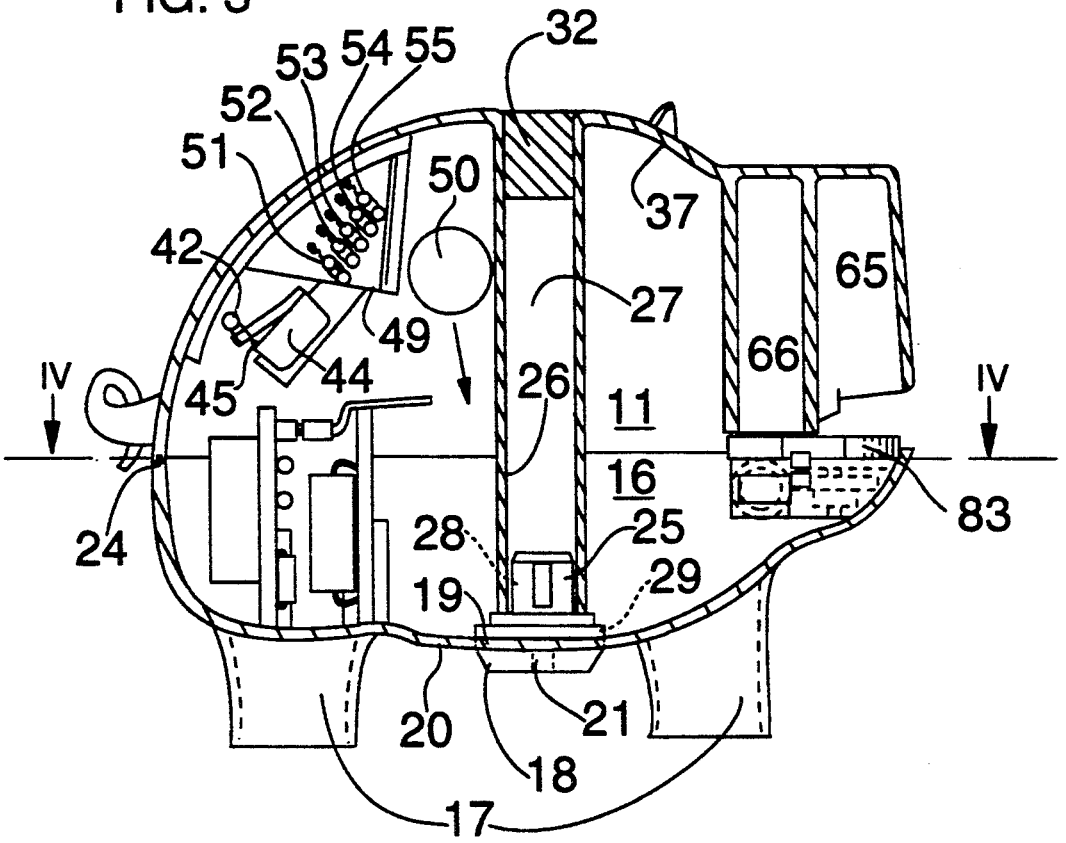
FIG. 3 is a view taken along lines III—III of FIG. 1.

Referring now to FIG. 1 of the drawing, a bank 10 in accordance with the invention is shown. Although the bank 10 is shown in the drawing as a piggy bank, obviously it can take a variety of shapes. Thus, bank 10 may have a main rounded upper body portion 11, a simulated tail 12 and a simulated nose or snout 13. Simulated eyes 14 and ears 15 may also be provided. The body of bank 10 is completed, as seen in FIG. 2, by a lower body portion 16, having integral simulated legs 17, generally conforming to and mating with upper body portion 11 at a tongue and groove connection 24 (FIG. 3). A conventional lock 18 (see particularly FIG. 3) is mounted in a hole 19 in the bottom wall 20 of lower body portion 16. Lock 18 has a keyhole 21 (dotted lines in FIG. 3) adapted to receive therein a key 22 (FIG. 2) for opening and closing lock 18. Lock 18 has an extension portion 25 (see also FIG. 4) which is adapted, when key is turned, to rotate and bear against the inner wall 26 of tube 27 to provide a friction lock. As seen in FIG. 3, the body portion 28 of lock 18 is irregularly shaped in cross-section to provide a loose fit within tube 27 so that extension portion 25 can be frictionally moved against wall 26 retaining lower body portion 16 to upper body portion 11. A nut 29 is threadably mounted on lock 18 bearing against the inner wall 30 of lower body portion 16 which, together with enlarged head portion 31 of lock 18, secures lock 18 to lower body portion 16.

A plug 32 closes off the open upper end of tube 27. As seen in FIG. 1, a slot 33 is provided in the upper surface of upper body portion 11 for receiving a coin therein. Slot 33 is normally closed by an arcuately shaped plate 34 (FIG. 5) having a lever 35 integral therewith (see also FIG. 6). As particularly see in FIG. 6, plate 34 is movable within a slotted housing portion 36 secured to the inner wall 37 of upper body portion 11 and having a slot 38 (which is the cross-section of ramp 49 formed at the bottom, as will be discussed) receiving therein an extension portion 39 of lever 35. Plate 34 extends on both sides of extension portion 39 and is movable within a slot 40 formed in flange portion 41 of housing portion 36 which is integral with or otherwise secured to inner wall 37.

As seen in FIGS. 5 and 7, the extension portion 39 of lever 35 is adapted to engage a switch 42 resiliently or pivotably coupled, at connection 43, to an infrared light source 44 (see also FIG. 6). As can be seen in comparing FIGS. 5 and 7, when lever 35 is moved to the FIG. 7 position, extension portion 39 engages switch 42 moving it into contact with contact 45 on light source 44 actuating the same. Such light source 44 may be coupled via fiberoptic conductor 47 to photodiodes 51 to 54 (FIG. 5) (only photodiode 51 is shown in FIG. 6). A timer is associated with plate 34 to keep plate 34 open for a predetermined time. At the end of such predetermined time, switch 42 moves back automatically to the FIG. 5 position. A flat electrical conduit 48 couples light source 44 to the electronic mechanism as will hereafter be described.

Figure 4:
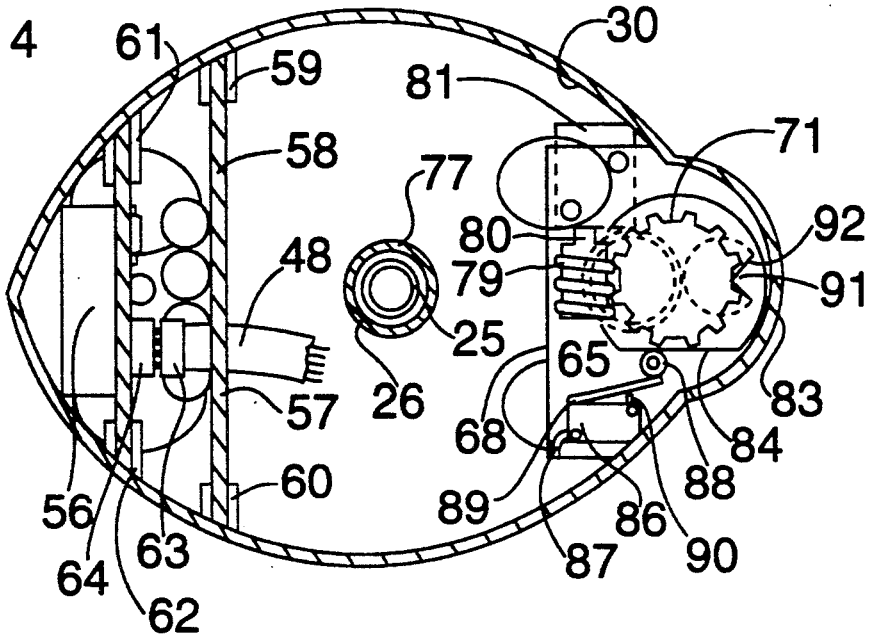
FIG. 4 is a view taken along lines IV—IV of FIG. 3.

When plate 34 is moved to the FIG. 7 position, an internal inclined ramp 49 is exposed (FIG. 7) and, when a coin 50 is deposited in slot 33, it rolls down ramp 49. As seen in FIG. 6, the width of slot 33 corresponds to the width of aligned slot 38 which width may be slightly greater than the width of a coin. As seen in FIG. 7, a plurality of photodiodes 51 to 55 are provided conforming to the height of a conventional U.S. coin, such as a dime, penny nickel, quarter and half-dollar, respectively. These photodiodes 51 to 55 are coupled, via fiberoptics, to a circuit board 56 (FIG. 3) mounted internal of bank 10 on the lower body portion 16 therein for powering the circuit board 56. Light source 44 is also coupled, via conduit 48, to board 56. As seen in FIG. 4, plate 58 is removably mounted between spaced slotted flanges 59, 60, respectively, on the inner wall 30 of lower body portion 16. In like manner, circuit board 56 is also removably mounted between spaced slotted flanges 61, 62, respectively, mounted on the inner wall 30 of lower body portion 16. Conduit 48 (FIG. 4) terminates in a snap on connector 63 mating with a like connector 64 on board 56 to provide the electrical coupling.

As seen in FIG. 3, when coin 50 is deposited in slot 33, it rolls down ramp 49, past diodes 51 to 55, and falls into the interior of bank 10 on top of inner wall 30 of the lower body portion 16. When coin 50 passes diodes 51 to 55 and the light beam from light source 44, the height of the coin 50 blocks one or more light beams striking diodes 51 to 55 (e.g., diodes 51 to 53 in FIG. 7), which signals the circuitry on board 56. This totals the value of the coins deposited and, when the total value of the coins deposited reaches a predetermined amount, such as twenty-five cents, the bank 10 returns a coin to the depositor of a predetermined value, such as five cents, in interest.

Figure 9:
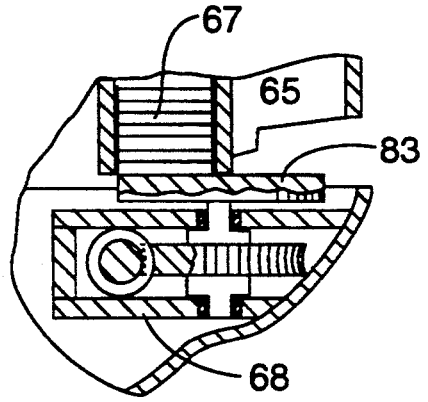
FIG. 9 is a view taken along lines IX—IX of FIG. 8.
Figure 10:
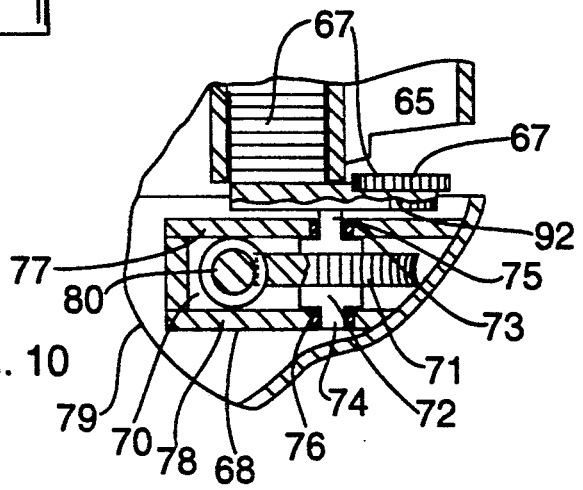
FIG. 10 is a detailed cross-sectional view of still another portion of the bank of FIGS. 1 to 4.

Thus, as seen in FIG. 3, a tube 65 extends downwardly from the inner wall 37 of upper body portion 11 and is open at the bottom end 66. As seen in FIGS. 9 and 10, tube 65 has an inner diameter slightly greater than the coin diameter to be returned as interest, such as a nickel. Thus, when the bank 10 is opened as heretofore discussed, a plurality of coins, such as nickels 67, can be inserted into tube 65 and the bottom portion 16 secured to upper body portion 11 before reinverting bank 10 to restore it to the FIG. 2 position.

As seen in FIG. 4, a coin return housing 68 is mounted on the inner wall 30 of lower portion 16 adjacent the lower simulated mouth portion 69 (see also FIG. 2) of bank 10. As seen in FIG. 10, housing 68 has an internal slot 70 having a gear 71 mounted therein. Gear 71 has a central shaft 72 with reduced ends 73, 74 rotatable in bearings 75, 76, respectively, of housing 68. Gear 71 meshes with a worm gear 79, mounted on shaft 80. Shaft 80 (FIG. 4) is rotatably coupled to a motor 81 (see also FIG. 8). As seen in FIG. 8, when motor 81 rotates shaft 80 to thereby rotate worm gear 79, meshing gear 71 rotates in the direction of arrow 82.

A turntable or plate 83 (FIG. 9 and 10) is fixedly secured to end 73 of shaft 72 and thus rotates when shaft 72, coupled to gear 71, rotates. As seen in FIG. 8, plate 83 is generally round with a flattened portion 84 on one side thereof. It is to be understood that motor 81 is electronically coupled via conduit 85 (FIG. 4) to circuit board 56. It is also to be understood that switch housing 86 (FIG. 4), mounted in housing 68, is also coupled to motor 81 via conduit 87. Switch housing 86 has a movable contact 88 pivotally hinged or otherwise connected to housing 86 at connection 89 and adapted to be moved into engagement with a fixed contact 90 on switch housing 86. When plate 83 is rotated to a position where flat portion 84 engages switch 88, as seen in FIG. 4, the switch is open and rotation of plate 83 stops. When the nonflattened periphery of plate 83 engages switch 88, as seen in FIG. 8, the switch is closed and plate 83 turns in the direction of arrow 82.

As particularly seen in FIG. 10, plate 83 has a reduced thickness portion 91 adapted to receive a nickel 67 thereon. As seen in FIG. 4, when nickel 67 is not visible in portion 91, the diameter thereof is generally related to the diameter of nickel 67.

Also as seen, a V-shaped notch 92 is provided in plate 83 below the upper surface of portion 91 (see FIG. 10) to allow nickel 6 to extend slightly beyond plate 83 to provide easy grasping thereof by the coin depositor.

Thus, as seen in FIG. 9, when nickels 67 are deposited in tube 65, the lowermost nickel is deposited in reduced portion 91 of plate 83. When plate 83 is rotated to the FIG. 10 position, nickel 67 is presented to the depositor in the simulated mouth 69 of bank 10. The worm gear coupling prevents manual rotation of plate 83 in either direction by the depositor.

Figure 11A:
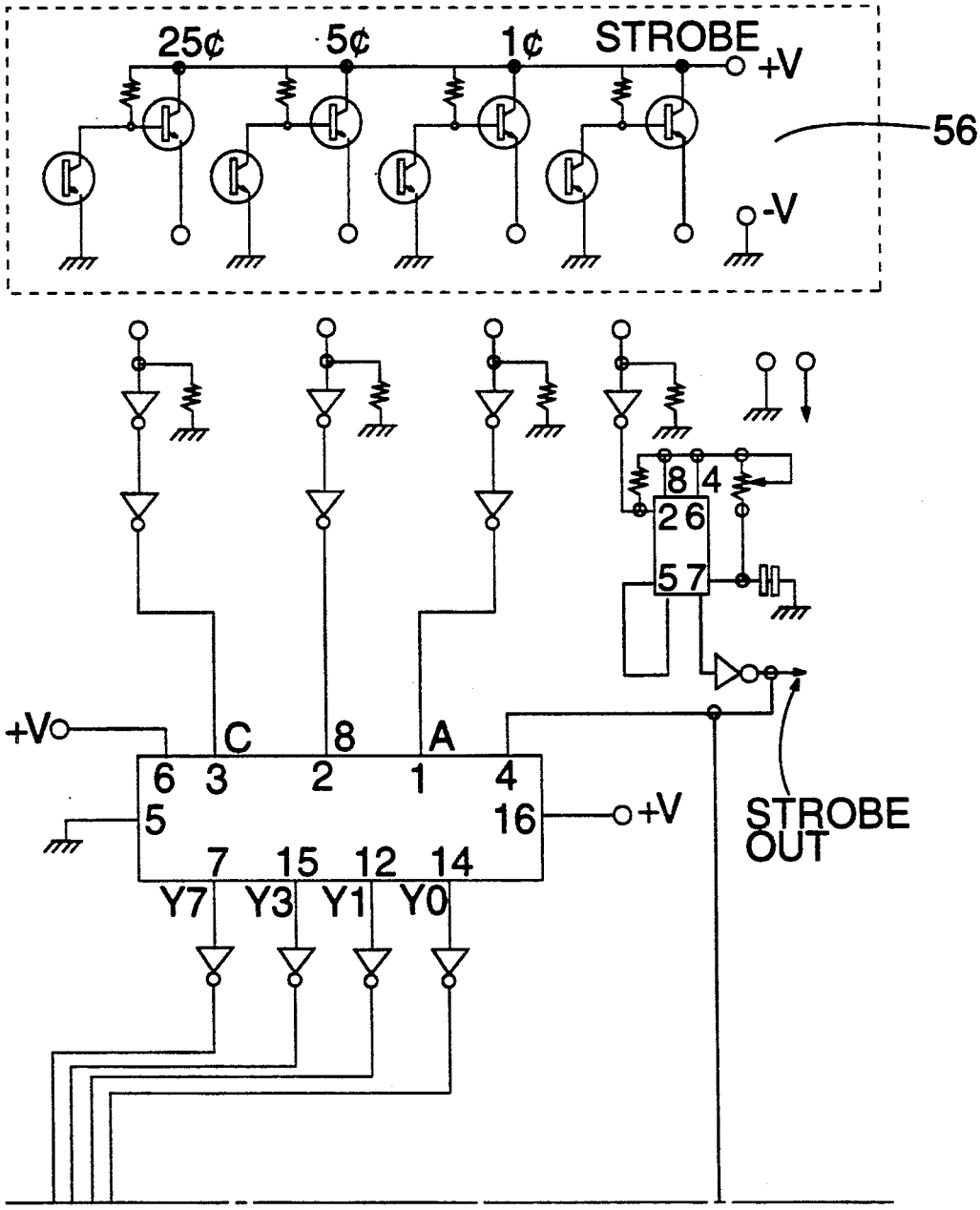
FIG. 11 (shown as FIGS. 11*a* and 11*b* is a schematic illustration of the electronic operating mechanism of the bank of FIGS. 1 to 10.
Figure 11B:
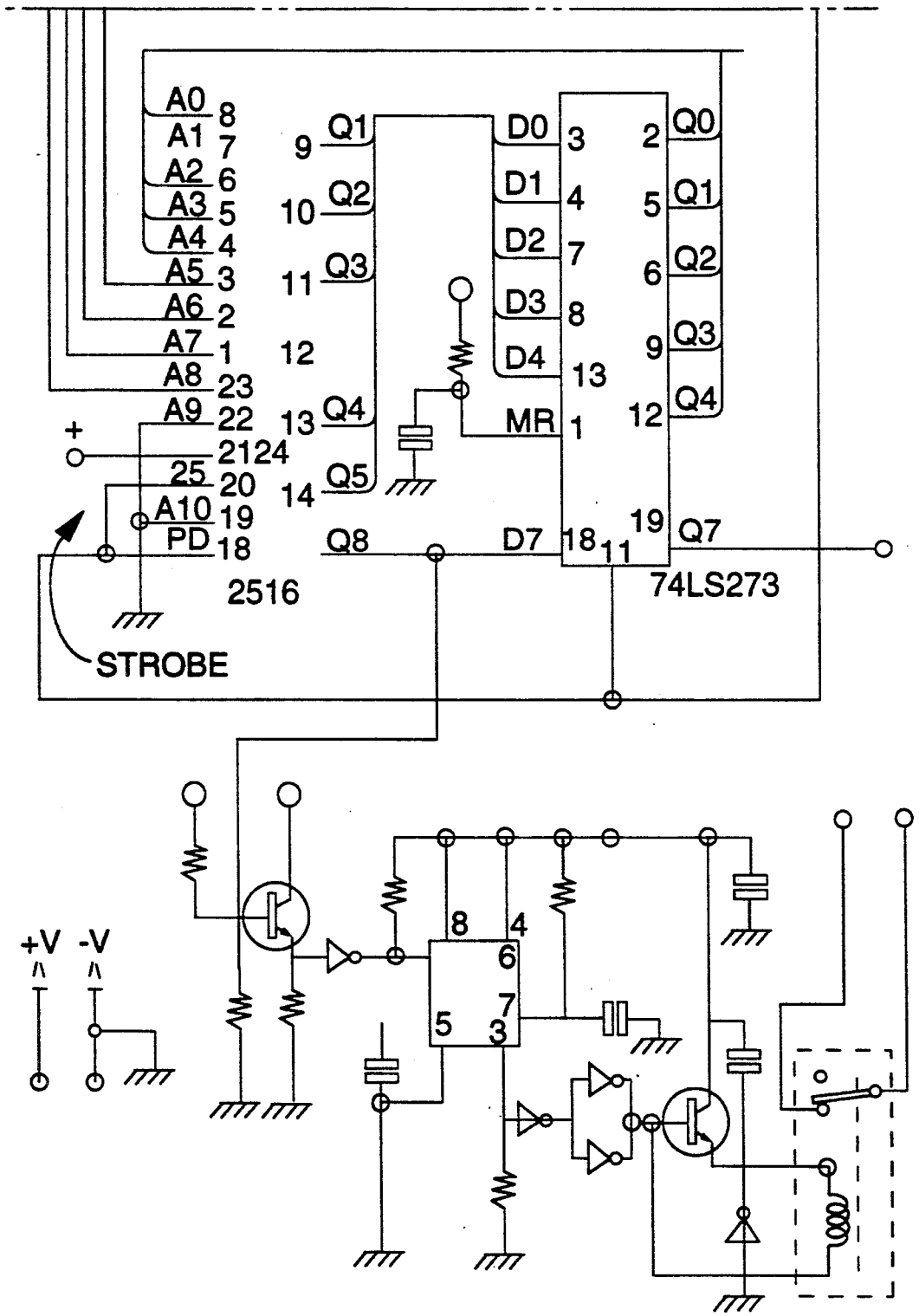

As depicted in FIGS. 5, 11*a* and 11*b*, a circuit board is provided to coordinate the input from the photodiodes with the movement of the motor and timer. Such a circuit board is depicted in the figures. However, alternative designs means for performing this task are also to be considered within the scope of the invention.

It can be seen that, as the coins are deposited in slot 33, the denomination of the deposited coins is totalled. When they reach a predetermined amount, such as twenty-five cents, motor 81 is actuated one revolution to rotate plate 83 (having a nickel 67 at the bottom of tube 65 resting in reducing portion 91 of plate 83) to deliver said nickel to the front (FIG. 10). The depositor takes the nickel and the timer, after a predetermined time, e.g., one minute, closes slot 33 and rotates plate 83 back to the FIG. 9 position wherein another nickel 67 at the bottom of tube 65 is deposited into reduced portion 91. When nickels 67 are exhausted, the key 22 can be used to open the bank 10 and any deposited coins removed, if desired, and the stack of nickels in tube 65 replenished.

Any suitable materials or components may be used. Motor 81 may rotate shaft 80 at about 20 rpms. Although the entire bottom portion 16 may be separated from the top portion 11, obviously, if desired, a trap door may be provided solely to remove deposited coins. The photodiodes and fiberoptic elements detect the height of the coins as they roll down ramp 49. When these coins total twenty-five cents, the motor 81 is actuated. When the flat portion 84 of plate 83 engages microswitch 88, rotation of plate 83 stops.

Figure 12:
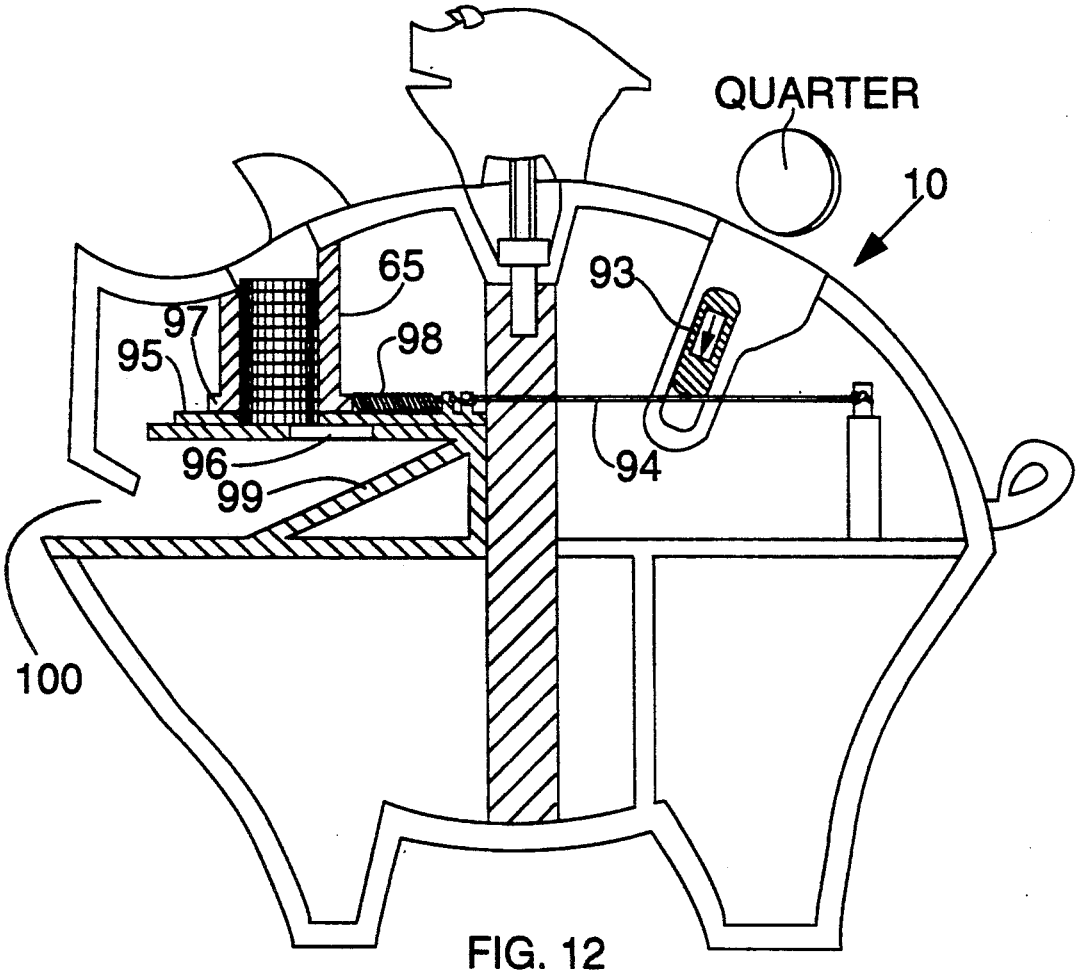
FIG. 12 is sagittal view of a simplified version of a bank of the subject invention.

FIG. 12 depicts a simplified bank 10 of the subject invention wherein the coin detecting and signalling means comprise a slidably mounted component 93 configured in such a manner so that when a coin of a given denomination has been inserted into the opening in the housing, the component moves from a first resting position (position depicted) to a second detecting position (see arrow). The movement of the component to the second position signals the coin storage and return means to return a coin of a predetermined denomination to the exterior of the housing. As depicted, the slidably mounted component 93 engages a string 94 which signals the coin storage and return means by pulling the skid 95 to a position above a void 96 to cause the release of a coin of a predetermined denomination.

The coin storage and return means comprise a tube 65, a skid 95, means for moving the skid, and a ramp 99. The tube 65 capable of storing a plurality of coins of a predetermined denomination. The skid 95 is mounted directly below the tube 65. The skid has a thickness approximately the same as one of the coins of a predetermined denomination and an aperture 97 therein large enough to accommodate one of the coins of a predetermined denomination. The aperture is aligned with the tube so that when coins are stacked within the tube, the bottommost coin is located within the aperture of the skid. Means for moving the skid to a second position wherein the aperture of the skid aligns with a void 96 are provided. Upon reaching the second position, a coin located within the aperture 99 falls through the void 96 in a downward direction. As illustrated, means for moving the skid to a second position includes the string 94 attached to the skid 95. The skid is then returned to the first position by a spring 98.

The ramp 99 is located at an angle below the void and is configured in such a manner so as to direct a coin that falls from the void through a second opening 100 in the housing to the exterior.

The scope and spirit of the subject invention are only to be limited by the claims and their equivalents.

What is claimed is:

1. A savings bank comprising:

(a) a housing defining an interior space for containing a plurality of coins, the housing having an opening leading into the interior space;

(b) coin detecting and signaling means connected to the housing and associated with the opening for detecting a coin that has been deposited into the opening and generating a signal; and (c) coin storage and return means in the interior space of the housing connected to the detecting and signaling means for storing a plurality of coins of a predetermined denomination in the interior of the housing and returning one of the coins of predetermined denominations to the exterior of the housing upon receipt of a signal from the coin detecting and signaling means, the coin detecting and signaling means having a slidably mounted component configured in such a manner so that as a coin is inserted into the opening in the housing, the coin causes the component to move from a first resting position to a second detecting position, the movement of the component to the second position signaling the coin storage and return means to return one of the coins of a predetermined denomination to the exterior of the housing the coin storage and return means having a tube for storing the plurality of coins of a predetermined denomination, a skid mounted directly below the tube, the skid having a thickness approximately the same as one of the coins of a predetermined denomination and an aperture therein large enough to accommodate one of the coins of a predetermined denomination, the aperture being aligned with the tube when the skid is in a first position so that when the coins are stacked within the tube, they form a vertical array with the bottommost coin being within the aperture of the skid, means for moving the skid to a second position wherein the aperture of the skid aligns with a void so that the coin located within the aperture falls through the void in a downward direction, and a ramp located at an angle below the void, the ramp configured in such a manner so as to direct a coin that falls from the void through a second opening in the housing to the exterior.

2. A savings bank of claim 1, wherein the bank is a simulated pig, the storage and return means being adapted to return on the coins of predetermined denomination through the pig's mouth.

* * * * *